US005609516A

United States Patent [19]

Courson et al.

[11] Patent Number: 5,609,516

[45] Date of Patent: Mar. 11, 1997

[54] ROTATING ABRADER WITH POLYGONAL PAD AND DUST EVACUATION

[76] Inventors: Michael W. Courson, 1088 Thunderbird, El Paso, Tex. 79912; Daniel C. Courson, 12806 Traviata, Houston, Tex. 77024; William H. Courson, 1088 Thunderbird, El Paso, Tex. 79912

[21] Appl. No.: 533,262

[22] Filed: Sep. 25, 1995

[51] Int. Cl.[6] ..... B24B 23/02

[52] U.S. Cl. ..... 451/456; 451/359

[58] Field of Search ..... 451/353, 359, 451/456

[56] References Cited

U.S. PATENT DOCUMENTS

| | | | |
|---|---|---|---|
| 4,355,487 | 10/1982 | Maier et al. | 451/456 |
| 4,759,155 | 7/1988 | Shaw | 451/456 |
| 4,930,264 | 6/1990 | Huang | 451/456 |
| 4,932,163 | 6/1990 | Chilton et al. | 451/456 |
| 4,939,872 | 7/1990 | Revelin et al. | 451/359 |
| 5,218,790 | 6/1993 | Huang | 451/456 |

*Primary Examiner*—Willis Little

*Assistant Examiner*—Eileen P. Morgan

*Attorney, Agent, or Firm*—John R. Duncan; Frank D. Gilliam

[57] ABSTRACT

An assembly for mounting an abrasive sheet on a rotary abrading tool having a circular mounting member fastenable to the tool drive shaft and having an opposite surface bearing a typically square raised backup pad to which a square sheet of abrasive material can be fastened. Other straight edged backup pad configurations can be used if desired. Entrance holes are formed through the mounting member adjacent to the backup pad. A circular shroud is provided on the mounting member surface opposite the backup pad covering the exit holes. Air and dust are evacuated from said shroud and holes with a vacuum or built-in impeller evacuation system. The shroud has a diameter less than that of the mounting member and may have an edge engaging a circular groove in the mounting member to minimize air leakage between shroud and mounting member. The back up pad may be a reversible, double sided pad snapped into a mounting member recess. Additional dust evacuation holes and grooves may be formed in the backup pad itself. This assembly provides improved abrasion efficiency in sanding, grinding and polishing operations and substantially eliminates abrader edge grooving or damaging of workpiece surfaces.

24 Claims, 3 Drawing Sheets

FIGURE 6
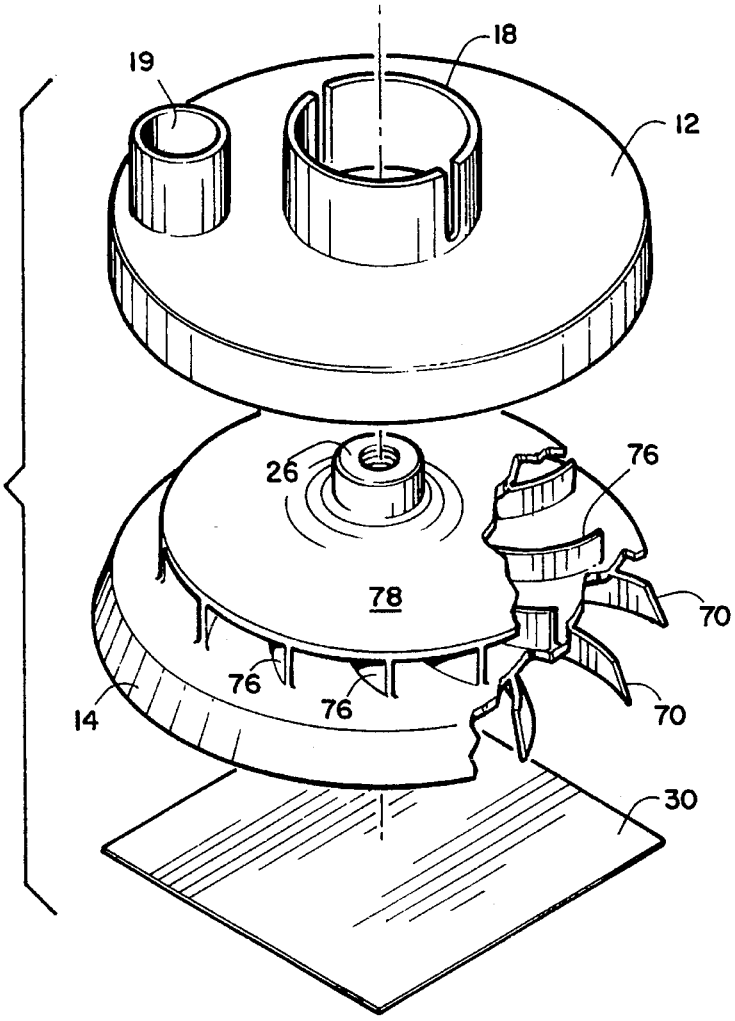
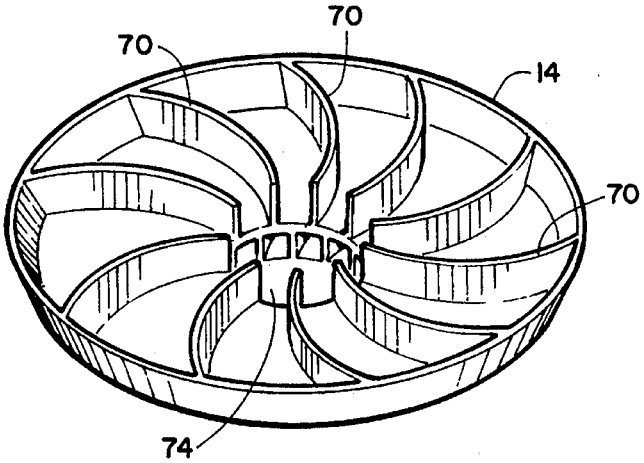
FIGURE 6A

ROTATING ABRADER WITH POLYGONAL PAD AND DUST EVACUATION

BACKGROUND OF THE INVENTION

This invention relates in general to rotating disk abraders and, more specifically, to such abraders using a square or polygonal pad and having a more effective abrading dust removal system.

High speed disk abraders, which also may be used for grinding and polishing, are the fastest abrasive material removal hand tool available. They are not used for fine finishing or precision bulk material removal because of the poor finishes produced by the usual round abrasive pads. Slower abrasive tools such as belt sanders, orbital or vibrating finish sanders or large floor mounted machinery must be used to achieve a fine, even, finished surface.

A round backup pad with a corresponding round abrasive sheet is used in rotating abrasive machines. Typical of these machines is that described by Hutchins in U.S. Pat. No. 4,145,848. This arrangements has a very aggressive abrading/cutting surface at the outer, circular, edge of the abrasive sheet. The operator normally uses the feel of the outer portions of the rotating pad to stabilize the position of the abrasive sheet relative to the surface being abraded. Because of the greater amount of abrasive near the outer edge of the circular-sheet relative to areas near the sheet center and the extremely high rim speeds of the outer edge of the sheet, combined with the fine line around the outer edge of the abrading sheet, slightly tilting the pad quickly and easily cuts gouges and uneven surfaces into the work. As the pad is moved across a surface being abraded, which may be flat or convex, it is very difficult to hold the pad and sheet perfectly even with the surface bing abraded.

An additional problem with high speed rotating abrading tools is the large quantity of dust produced. Current systems couple an external vacuum and collection system to a shroud covering the back side and edges of the backup pad holding the abrading sheet. Many combine holes through the abrading sheet and backup pad, communicating with a vacuum shroud covering the back of the backup pad. Besides the expense and awkwardness of having to use an external vacuum and collection system with a hand held sander, the current systems tend to be inefficient for several reasons. Centrifugal forces tend to throw dust toward and beyond the outer edge of the abrading sheet, with the outer, high speed, portion of the sheet doing the major part of the material removal. Holes through the abrading sheet can, at best, capture dust produced axially of the holes. Further, since the abrading sheet is pressed tightly against the workpiece surface during abrading, there is little room for dust or the necessary volume of air to move along the surface to the holes.

In some cases spiral grooves are provided in the backup pad, such as are shown by Hempl et al. in U.S. Pat. No. 5,105,585 to attempt to capture additional dust and direct it to extraction holes through the pad. Only a small portion of the exiting dust is captured, since much exits between grooves and is moving at high speed away from the vacuum extraction direction.

In an attempt to capture dust abraded from the surface at the abrading disk edges vacuum shrouds have been designed that cover the entire back of the backup pad and extend well beyond the edges of the pad. While these shrouds are fairly effective, some problems remain.

Abrading dust is propelled by centrifugal forces outwardly of the pad at high speed and must reverse direction in a very short distance to move back over the top of the pad to the vacuum coupling. Some dust will escape, particularly where grinding or abrading high density materials, such as metals. These large shrouds also limit the operator's visibility of the working portion of the tool and of the workpiece surface where the abrading is being done.

A fully enclosed abrading disk cannot be brought close enough to an upstanding second surface to abrade close to it. The weight, size, visibility and abrading limitations of these shrouds tends to discourage their use. In some cases, a section of the shroud is cut away to allow part of the backup pad to extend beyond the shroud. While this allows close approach to an upstanding surface, the limited cut out often makes maneuvering the tool difficult and severely limits the effectiveness of the vacuum system. Further, when sanding the edge of a surface such as a table top edge, much of the vacuum is in effect lost when the shroud extends over the edge.

While most rotary abraders use circular abrading disks, for a few specialized purposes narrow strips of abrasive material in a crossed configuration are used, such as are described by Duckworth in U.S. Pat. No. 5,403,231 for use in fairing the complex curves of boat hulls and the like. Also, so-called "star" heads having a plurality of narrow strips extending radially from a center hub. These are effective with complex curved surfaces, deburring edges and the like but are relatively ineffective in abrading plane or simple convex surfaces. Further, since the width of the strips are substantially uniform over their lengths, they suffer from the problems of higher abrasion speed along the outer edge discussed above.

Manufacture of round or star-shaped abrading sheets is uneconomical, since there is much wasted material when such shapes are cut or punched from a large sheet of abrading material. Also, more complex equipment is required for cutting such shapes than would be the case with simple, square shapes.

Thus, there is a continuing need for improved rotary abrading systems which more effectively and completely remove abrading dust from the abraded area, simplify and localize the vacuum/collection system, avoid gouges or uneven surfaces caused by slight tilting of the abrading sheet in use, provide a more uniform abraded surface, use more easily and economically manufactured abrading sheets.

SUMMARY OF THE INVENTION

The above-noted problems, and others, are overcome in accordance with this invention by a pad assembly for mounting a sheet of abrasive material on a rotary abrading tool comprising a generally circular mounting member with a flat first surface and a second, opposite, surface having a mechanism for securing the mounting member to a rotary abrading tool shaft for rotation therewith, a backup pad fastened to the flat surface, the backup pad having an edge made up of a sequence of straight lines, (preferably a square). The exposed surface of the backup pad is adapted to having a sheet of abrading material secured thereto.

In order to evacuate dust formed by the abrading operation, a shroud is preferably placed over the second side of the mounting member, forming a chamber encompassing a central area of the mounting member. Peripheral holes are provided through the mounting member inside and/or outside the periphery of the backup pad, the holes communicating with the shroud chamber. An outlet is provided in the shroud for connection to a conventional vacuum system. Thus, as the assembly is rotated with an abrasive sheet on the backup pad in contact with a workpiece surface, dust is forced outwardly by centrifugal forces to the region of the holes, so that the dust can be evacuated through the holes. Dust evacuation is enhanced by the space between the mounting member and the workpiece surface adjacent to the backup pad.

Further holes can be formed directly through the backup pad and an abrasive sheet thereon to allow the vacuum to extract dust directly from the abrasive surface. Such dust extraction can be further enhanced by grooves formed in the backup pad surface behind the abrasive sheet, running from the backup pad holes to the edges of the backup pad to allow dust to move outwardly to the peripheral holes for evacuation.

Abrasive sheets can be secured to the backup pad in any suitable manner. The backup pad may have a smooth surface and abrasive sheets with a layer of releasable, pressure-sensitive adhesive on the back may be bonded to the backup pad and later stripped off when worn. Hook and loop material, such as that sold under the Velcro trademark, can be used, with either hook or loop material permanently applied to the backup pad with the cooperating material bonded to the backs of abrasive sheets.

The back up pad may be an independent sheet of stiff material, such as a plastic, with abrasive bonded to both sides. Each side may have the same abrasive grit size with the pad turned over when one side becomes worn out. Or, two different grit sizes may be used on the two sides, so that the user can initially sand with the more coarse grit, then turn the pad over to the fine grit for finish sanding. The backup pad may be installed into a recess in the mounting member so that the exposed abrasive sheet extends at least 0.02 inch beyond the mounting member surface. When worn., the backup pad can be removed and reversed.

In an alternate embodiment, a backup disk of any desired shape is fastened to a planar first array of fins on a first side of a circular plate. The first array of fins is configured to direct air toward a central opening in the plate. A second array of fins is secured on the second side of the plate, configured to direct air away from the central plate opening. A shroud surrounds the second array of fins and includes an air exhaust opening. In use during abrading, air carrying abrading dust enters between the surface being abraded and a skirt around the periphery of the first fin array and is directed to and through the central plate opening by the first array of fins, then outwardly to the exhaust opening by the second fin array. Dust laden air exhausted may be dirrected to any collection means, such as a air permeable bag on the tool. Thus, no exterior vacuum system, with cumbersome hoses or the like, is required with this embodiment.

BRIEF DESCRIPTION OF THE DRAWING

Details of the invention, and of preferred embodiments thereof, will be further understood upon reference to the drawing, wherein:

FIG. 6 is an exploded view of an embodiment with an alternative dust evacuation system; and FIG. **6*a* is a perspective view of the underside of the dust evacuation system of FIG. 6**.

DETAILED DESCRIPTION OF PREFERRED EMBODIMENTS

Figure 1:
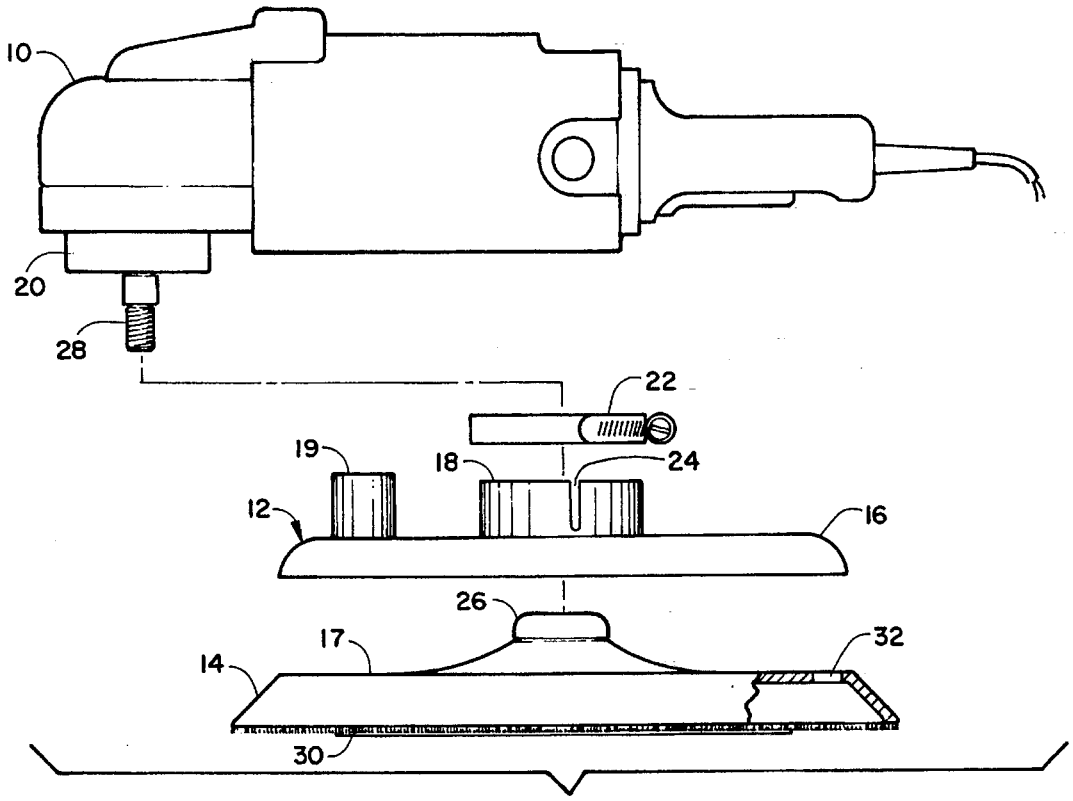
FIG. 1 is an exploded side view of the assembly of this invention with a rotary abrading tool.

Referring to FIG. 1, there is seen an exploded view of an assembly basically including a conventional high speed rotary drive 10, a dust evacuation shroud 12 and a mounting member 14 for carrying a sheet of abrasive material.

Any suitable rotary drive 10 may be used, such as angle drives as shown, straight line drives, either stationary or portable, etc.

Shroud 12 includes a central enclosure 16 sized to fit against (or preferably closely spaced from) the upper surface of mounting member 14. If desired, a narrow groove 17 may be formed in the upper surface of mounting member 14 to receive the edge of enclosure 16, or an upstanding ridge may be formed on that upper surface closely adjacent to the edge of the enclosure to reduce air leakage past the shroud/mounting member interface. A tubular outlet 19 is sized to fit a conventional vacuum system, such as a centralized or portable shop vacuum. A collar 18 is sized to fit over a shoulder 20 on drive 10. Collar 18 is secured to shoulder 20 by any suitable clamping means, such as a conventional hose clamp 22. One or more axial slots 24 may be provided in collar 18, if desired to provide greater flexibility during clamping.

Mounting member 14 includes a means for rotatably mounting the member on the rotary tool. Typically, this will included internal threads in projection 26 to thread onto drive shaft threads 28 of tool 10.

A backup pad 30 for holding a sheet of abrasive material is secured to the flat lower surface in any suitable manner. Typically, backup pad 30 is adhesively bonded to a solid surface of member 14. If desired, the area behind backup pad 30 can be hollowed out or may be a pattern of ribs of even height.

Figure 2:
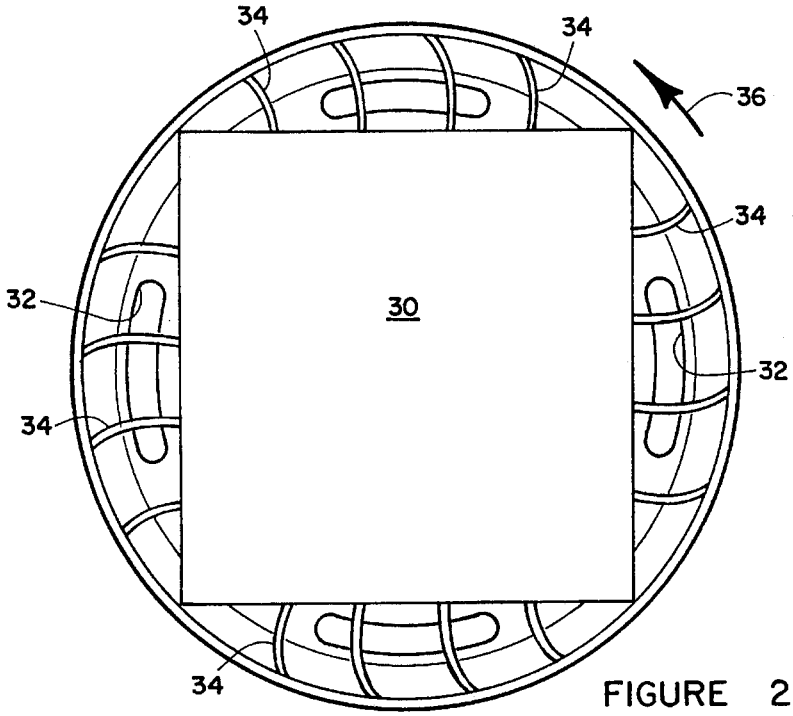
FIG. 2 is a bottom plan view of one embodiment of the assembly with peripheral dust evacuation.

As seen in FIGS. 1 and 2, a plurality of holes or slots 32 are formed through the upper surface of mounting member 14 into cavities-adjacent to or over backup pad 30. These slots allow air and dust particles to be drawn from adjacent to backup pad 30 through slots 32 and shroud 12 to the vacuum evacuation system. Since mounting member 14 is spaced above the workpiece surface adjacent to pad 30, air is easily drawn in from beyond the edge of the mounting member, carrying exiting dust with it.

A pattern of curved ribs 34 may be provided in the cavity between the edge of backup pad 30 and the edge of mounting member 14. Where the assembly is rotated in the direction of arrow 36, ribs 34 will be oriented as shown to "scoop" dust particles back toward slots 32 and out through the dust removal system. If desired, ribs 34 may extend in under backup pad 30, acting to both further pull dust particles inwardly and support the pad. The airflow created by ribs 34 also serve to cool the abrasive pad, which may be secured to backup pad 30 with a pressure sensitive adhesive that may release if over heated.

Any conventional abrasive sheet material may be fastened to backup bad 30, as detailed above. Any suitable fastening means may be used, such as edge clips, pressure sensitive adhesives, hook-and-loop material, etc. The components of the assembly may be formed from any suitable material. Mounting member 14 is preferably formed from a fiber filled Nylon, hard rubber or other plastic material, although aluminum or other metal may be preferred for heavy-duty applications, such as grinding welds. Where only flat surfaces are to be abraded, a harder material may be preferred, while for abrading a curved surface a softer, more flexible material may be optimum. For best results, backup pad 30 is formed from a rubber or plastic material, which may be the same material as the mounting member, so that the backup pad and mounting member could be integrally formed. A material, such as an acrylic or polycarbonate, is preferred for shroud 12 so that the effectiveness of abrasion and dust removal can be easily observed.

Any suitable backup pad and corresponding abrasive sheet configuration having an edge formed from a succession of straight lines may be used. A pointed star-like pattern, a square of polygonal shape having up to about six sides may be used. In each case, the edge should provide a series of "points" resulting from corners formed by succeeding approximately straight edge lines. Rounded edges or edges formed by lines approximately perpendicular to a line drawn from the axis of rotation result in the edge speed and abrasive aggressiveness detailed above. Preferably, the angle between successive edge lines is at least about 60°.

An arrangement using a square backup pad 30 and a corresponding square abrasive sheet is preferred for the optimum combination of abrasive efficiency and smooth abrasion without the gouges or uneven surfaces caused by slight tilting of a conventional circular abrasive sheet. Further, square abrasive sheets can be cut from standard commercial rectangular abrasive sheets with minimum waste.

Backup pad 30 preferably extends at least about 0.020 inch above the flat surface of mounting member 14 to give the necessary clearance so that as the tool is operating and may be tilted very slightly, the edge of mounting member will not contact the workpiece surface, or, if slight contact occurs, no damage will be done to the surface. For optimum results, the backup pad will extend from about 0.02 to 0.25 inch above the mounting member surface to provide optimum air flow and debris collection characteristics. In most cases, an extension of about 0.05 inch is optimum.

Figure 3:
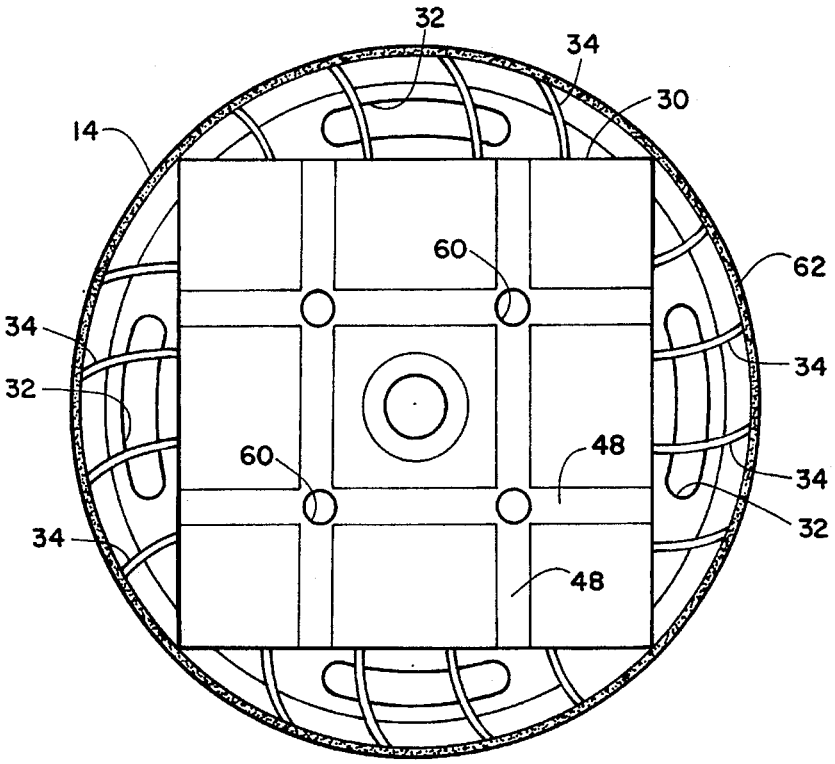
FIG. 3 ms an elevation view of an embodiment of the assembly without dust evacuation.

An alternative embodiment that does not include dust removal capability is shown in perspective view in FIG. 3. Here, backup pad 30 is mounted on a flat surface of a solid mounting member 14 and extends at least about 0.02 inch above that surface. Backup pad may be made separately from the mounting member and bonded thereto or may be molded integrally therewith. If desired, for reduced weight and improved cooling, mounting member may be hollow and ribbed as desired.

Figure 4:
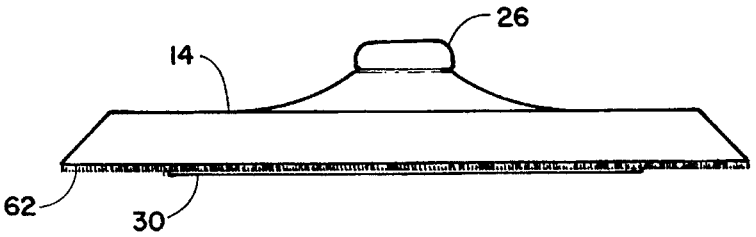
FIG. 4 is an exploded view of an embodiment of the assembly with a removable backup pad.

FIG. 4 illustrates another embodiment; in this case having a reversible backup pad 40. Mounting member 42 may have dust evacuation holes 44 to cooperate with a shroud as shown in FIGS. 1 and 2, or may be a solid member as shown in FIG. 3.

A recess 46 is provided in the flat surface of mounting member 42, corresponding to the size of the desired backup pad 40. Backup pad has a central panel 50 having dimensions slightly greater than those of recess 46, with pads 52 on either side. A groove 48 in the sidewall of recess 46 is sized to permit central panel 50 to be snapped thereinto and hold backup pad 40 in place. Abrasive sheets (not shown) may be fastened to each surface in the manner described above. Groove 48 is located such that when backup pad 40 is in place, the outer pad surface will extend at least about 0.02 inch, and preferably up to about 0.25 inch, above the surface of mounting member 42. If desired, a finger notch (not shown) may be cut into one edge of recess 46 to permit an installed backup pad 40 to be easily removed. Any other suitable method may be used for securing panel 50 in place, such as mechanical fasteners or clips.

Figure 5:
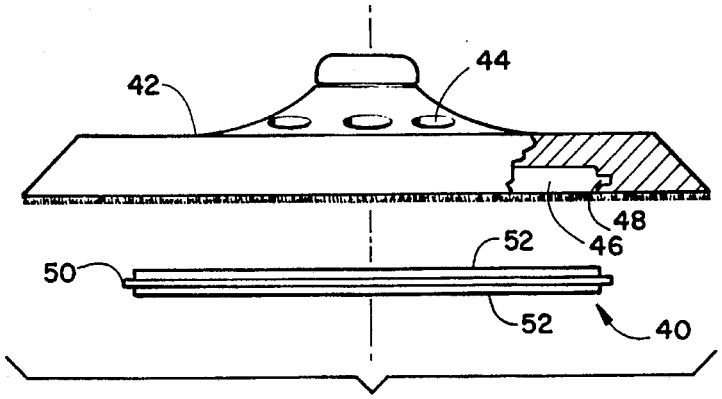
FIG. 5 is a perspective view of an embodiment of the assembly having central dust evacuation.

Another embodiment, having additional dust evacuation components, is shown in FIG. 5. Here, the overall configuration of mounting member 14, slots 32, ribs 34 and backup pad 30 are generally similar to those described in conjunction with the discussion of FIGS. 1 and 2. Dust near the center of an abrasive sheet (not shown) having holes 60 in communication with grooves 48 and bonded to the backup pad, will be drawn into and through the shroud. For optimum dust evacuation, a plurality of grooves 48, typically having depths of from about 0.03 to 0.2 inch are formed across the surface of backup pad 30, extending across holes 60 to the pad edges. Abrasive paper covers grooves 48 and has holes corresponding to holes 60. Dust will enter these grooves through openings 60 and will be directed to slots 32 for evacuation.

To further limit exit of larger or heavier dust particles thrown outwardly by centrifugal force, a downwardly extending lip 62 may be provided along the lower outer edge of mounting member 14. Particles hitting lip 62 will be stopped and/or bounced back, so that vacuum forces can overcome centrifugal forces and remove those particles. While any suitable material may be used for lip 62, a short fiber brush or a soft, non-marking plastic are preferred for effectiveness and non-marring of the surface being abraded should the assembly be tilted slightly during use.

An embodiment having a dust evacuation system that does not require a vacuum system connected to the shroud is shown in exploded view in FIG. 6. FIG. 6A is a perspective view of the underside of housing 14 without a backup pad 30 in place. Here mounting member 14 includes projection 26 into which a drive tool is threadable and a shroud 12 having a collar 18 for fastening to the tool. An exhaust fitting 19 is provided, but is connected to a dust collection container rather than to a vacuum system. In this embodiment, the mounting member and associated components provide the driving force for directing dust through fitting 19 to the dust collection means.

Mounting member 14 in this case includes a first array of fins 70 shaped so that when the mounting member is rotated in the direction indicated by arrow 72 air and entrained dust will be forced toward central opening 74, with a sloping skirt along the fin ends to so that exterior air is drawn in through the gap between the skirt edge (coplanar with the plane of outer edges of fins 70) and the surface being abraded. Backup pad 30 is mounted on a flat surface formed by planar outer fin edges 70 by adhesive bonding, welding or the like. Secured to the top exterior of mounting member 14 is a second array of fins 76, oriented to receive air and entrained dust from opening 74 and direct it outwardly to where it exits through fitting 19 to a conventional collection means, not shown. Typically, the collection means could be a conventional air-permeable filter bag mounted on the drive means. This embodiment has the advantage of not requiring an external vacuum system for dust collection.

A housing 78 encloses fin array 76 while allowing air and dust to pass therethrough. Projection 26 for connection to an abrading tool is mounted on housing 78 to connect the pad mounting assembly to the abrading tool.

While certain specific relationships, materials and other parameters have been detailed in the above description of preferred embodiments, those can be varied, where suitable, with similar results. Other applications, variations and ramifications of the present invention will occur to those skilled in the art upon reading the present disclosure. Those are intended to be included within the scope of this invention as defined in the appended claims.

I claim:

1. An assembly for mounting a sheet of abrasive material on a rotary abrading tool which comprises:

a mounting member having a generally circular outer edge;

said mounting member having a first generally flat surface;

a second surface opposite said first surface having means for securing said mounting member to a rotary abrading tool shaft for rotation therewith about an axis;

a backup pad on said flat surface having a thickness of at least about 0.020 inch;

said backup pad having an edge formed from a succession of approximately straight lines;

a shroud covering said backup pad and extending beyond widest diameter of said backup pad; and means for withdrawing air from said shroud;

whereby a sheet of abrading material having a configuration corresponding to said backup pad can be secured to said backup pad.

2. The assembly according to claim 1 wherein said backup pad edged is configured as a regular polygon having from 3 to 6 sides.

3. The assembly according to claim 1 wherein said backup pad edged is configured as a square.

4. The assembly according to claim 1 wherein said backup pad comprises two substantially identical pads bonded to opposite sides of similarly shaped but slightly larger panel;

said flat surface having a recess configured to receive said panel; and said recess having a peripheral groove sized and located to receive at least two generally opposite edges of said panel therein with one of said identical pads extending at least 0.02 inch beyond said flat surface outside of said recess;

whereby abrasive sheets may be bonded to each of said identical pads to permit said backup pad to be reversed as said abrasive sheets wear.

5. The assembly according to claim 1 wherein said mounting member includes a plurality of fins with fin edges making up said flat surface.

6. The assembly according to claim 1 wherein said shroud has a circular outer edge, the diameter of which is less than the diameter of said mounting member edge.

7. The assembly according to claim 1 further including at least one groove in the exposed surface of said backup pad extending from each of said at least one second hole to said backup pad edge.

8. The assembly according to claim 1 further including an axially extending lip along said mounting member outer edge.

9. The assembly according to claim 1 wherein said mounting member comprises a circular plate having a flat array of first curved fins along a first side of said plate, said backup pad secured to said first curved fins, a central opening through said plate, said first fins configured to direct air toward said opening when said mounting member is rotated in a first direction, an array of second curved fins on a second side of said plate configured to direct air away from said opening, a shroud enclosing said array of second curved fins and means for allowing air to egress said shroud.

10. An assembly for mounting a sheet of abrasive material on a rotary abrading tool which comprises:

a mounting member having a circular outer edge;

said mounting member having a first generally flat surface;

a second surface opposite said first surface having means for securing said mounting member to a rotary abrading tool shaft for rotation therewith;

a backup pad on said flat surface having a thickness of at least about 0.020 inch;

said backup pad having an edge configured as a regular polygon having from 3 to 6 sides;

at least one first hole through said mounting member from said flat surface adjacent to said backup pad to said second surface;

a shroud enclosing said hole at said second surface;

said shroud covering said mounting member second surface and extending beyond a widest diameter of said backup pad; and means for evacuating air from said shroud and hole; and means for securing a sheet of abrading material having a corresponding configuration to said backup pad.

11. The assembly according to claim 10 wherein said backup pad edged is configured as a square.

12. The assembly according to claim 10 wherein said backup pad comprises two substantially identical pads bonded to opposite sides of similarly shaped but slightly larger panel;

said flat surface having a recess configured to receive said panel; and said recess having a peripheral groove sized and located to receive at least two generally opposite edges of said panel therein with one of said identical pads extending at least 0.02 inch beyond said flat surface outside said recess;

whereby abrasive sheets may be bonded to each of said identical pads to permit said backup pad to be reversed as said abrasive sheets wear.

13. The assembly according to claim 10 wherein said mounting member includes a plurality of fins with fin edges making up-said flat surface.

14. The assembly according to claim 10 further including at least one second hole extending through said backup pad and said mounting member to said shroud.

15. The assembly according to claim 14 further including at least one groove in the exposed surface of said backup pad extending from each of said at least one second hole to said backup pad edge.

16. The assembly according to claim 10 further including an axially extending lip along said mounting member outer edge.

17. The assembly according to claim 10 wherein said mounting member comprises a circular plate having a flat array of first curved fins along a first side of said plate, said backup pad secured to said first curved fins, a central opening through said plate, said first fins configured to direct air toward said opening when said mounting member is rotated in a first direction, an array of second curved fins on the second side of said plate configured to direct air away from said opening, a shroud enclosing said array of second curved fins and means for allowing air to egress said shroud.

18. An assembly for mounting a sheet of abrasive material on a rotary abrading tool and for evacuating dust from said abrasive material which comprises:

a plate having a central opening;

means for mounting said plate on a rotary abrading tool for rotation thereby in a first direction;

a first array of fins on a first surface of said plate;

said first array of fins configured to direct air toward said central opening when said plate is rotated in said first direction;

means for mounting a backup pad on said outer edges;

a second array of fins on a second surface of said plate;

said second array of fins configured to direct air flow away from said central opening when said plate is rotated in a first direction;

a shroud substantially enclosing said second array of fins;

an air egress opening in said shroud.

19. The assembly according to claim 18 wherein said backup pad has an edge formed from a succession of approximately straight lines.

20. The assembly according to claim 19 wherein said edge forms a square.

21. The assembly according to claim 18 wherein a skirt surrounds said first array of fins so that outside air is drawn inwardly through a gap between said skirt and a surface being abraded.

22. The assembly according to claim 18 wherein said means for mounting said plate on an abrading tool comprises a housing over said second array of fins and connection means mounted on said housing for connection to an abrading tool.

23. An assembly for mounting a sheet of abrasive material on a rotary abrading tool which comprises:

a mounting member having a circular outer edge;

said mounting member having a first generally flat surface;

a second surface opposite said first surface having means for securing said mounting member to a rotary abrading tool shaft for rotation therewith;

a backup pad on said flat surface comprising two substantially identical pads bonded to opposite sides of similarly shaped but slightly larger panel;

said backup pad having an edge formed from a succession of approximately straight lines;

said flat surface having a recess configured to receive said panel;

said recess having a peripheral groove sized and located to receive at least two generally opposite edges of said panel therein with one of said identical pads extending above said flat surface;

whereby abrasive sheets may be bonded to each of said identical pads to permit said backup pad to be reversed as said abrasive sheets wear.

24. All assembly for mounting a sheet of abrasive material on a rotary abrading tool which comprises:

a mounting member having a first generally flat surface;

a second surface opposite said first surface having means for securing said mounting member to a rotary abrading tool shaft for rotation therewith;

a backup pad on said flat surface;

said backup pad having an edge formed from a succession of approximately straight lines;

said mounting member comprising a circular plate having a flat array of first curved fins along a first side of said plate;

said backup pad secured to said first curved fins;

a central opening through said plate;

said first fins configured to direct air toward said opening when said mounting member is rotated in a first direction;

an array of second curved fins on the second side of said plate configured to direct air away from said opening;

a shroud enclosing said array of second curved fins; and means for allowing air to egress said shroud.

* * * * *